US006769582B1

(12) United States Patent
Beletsky et al.

(10) Patent No.: US 6,769,582 B1
(45) Date of Patent: Aug. 3, 2004

(54) SECONDARY VERTICAL LATCHING LEVER AND SECONDARY HORIZONTAL LATCHING LEVER HOLSTERS

(75) Inventors: Robert J. Beletsky, Fallbrook, CA (US); Carl R. Eerdmans, Fallbrook, CA (US); Anthony G. Lefeber, Temecula, CA (US)

(73) Assignee: Bianchi International, Temecula, CA (US)

( * ) Notice: Subject to any disclaimer, the term of this patent is extended or adjusted under 35 U.S.C. 154(b) by 0 days.

(21) Appl. No.: 10/199,191

(22) Filed: Jul. 19, 2002

Related U.S. Application Data

(60) Provisional application No. 60/308,050, filed on Jul. 25, 2001.

(51) Int. Cl.[7] ..... F41C 33/02

(52) U.S. Cl. ..... 224/244; 224/911

(58) Field of Search ..... 224/244, 243, 224/245, 193, 911

(56) References Cited

U.S. PATENT DOCUMENTS

| | | | | | |
|---|---|---|---|---|---|
| 1,635,984 | A | * | 7/1927 | Corriston | 224/244 |
| 3,866,811 | A | * | 2/1975 | Hamby | 224/244 |
| 3,910,469 | A | * | 10/1975 | Baldocchi | 224/198 |
| 4,256,243 | A | | 3/1981 | Bianchi et al. | |
| 4,277,007 | A | | 7/1981 | Bianchi et al. | |
| 4,925,075 | A | | 5/1990 | Rogers | |
| 4,934,574 | A | | 6/1990 | Salandre | |
| 5,129,562 | A | | 7/1992 | Bianchi | |
| 5,199,620 | A | | 4/1993 | Beletsky | |
| 5,246,153 | A | | 9/1993 | Beletsky | |
| 5,275,317 | A | * | 1/1994 | Rogers et al. | 224/244 |
| 5,419,474 | A | | 5/1995 | Marx et al. | |
| 5,509,591 | A | * | 4/1996 | Carver | 224/244 |
| 5,573,157 | A | * | 11/1996 | Mauriello et al. | 224/244 |
| 5,918,784 | A | * | 7/1999 | Serpa | 224/244 |
| 5,961,013 | A | * | 10/1999 | Collins | 224/244 |
| 6,085,951 | A | | 7/2000 | Beletsky et al. | |
| 6,276,581 | B1 | * | 8/2001 | Glock | 224/244 |

* cited by examiner

*Primary Examiner*—Stephen K. Cronin
(74) *Attorney, Agent, or Firm*—John E. Wagner

(57) ABSTRACT

A holster for a handgun having a trigger guard including a pouch having housing members secured to inside and outside faces of the pouch, the inside face being that closest to the wearer of the holster. A finger-operated, essentially vertical, lever including a blocking end is urged into the space within the trigger guard by means of a spring and is secured to an inside housing member such that it would not be readily apparent or operable by anyone attempting to remove the handgun from the holster. The holster may also include elongated upwardly extending straps and a snap fastener which can be wrapped around the butt of the handgun constituting a thumb break securing device. A second embodiment includes a horizontal double lever arrangement which blocks removal of the trigger guard as described. A third embodiment utilizes a lever pinned to an outside housing member and having a vertical finger-operated button mounted flush with the surface of the outside housing member.

14 Claims, 8 Drawing Sheets

CONCEALMENT HOLSTER
WITH OUTBOARD LATCHING LEVER
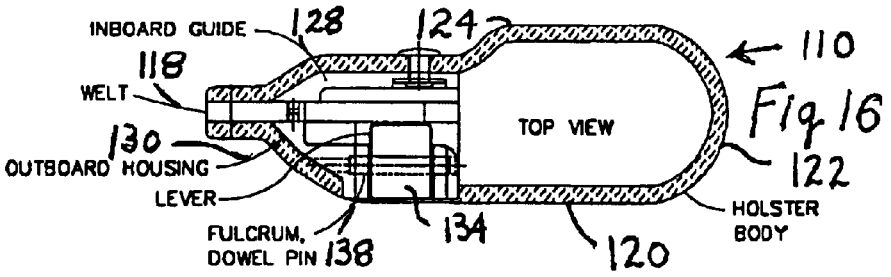
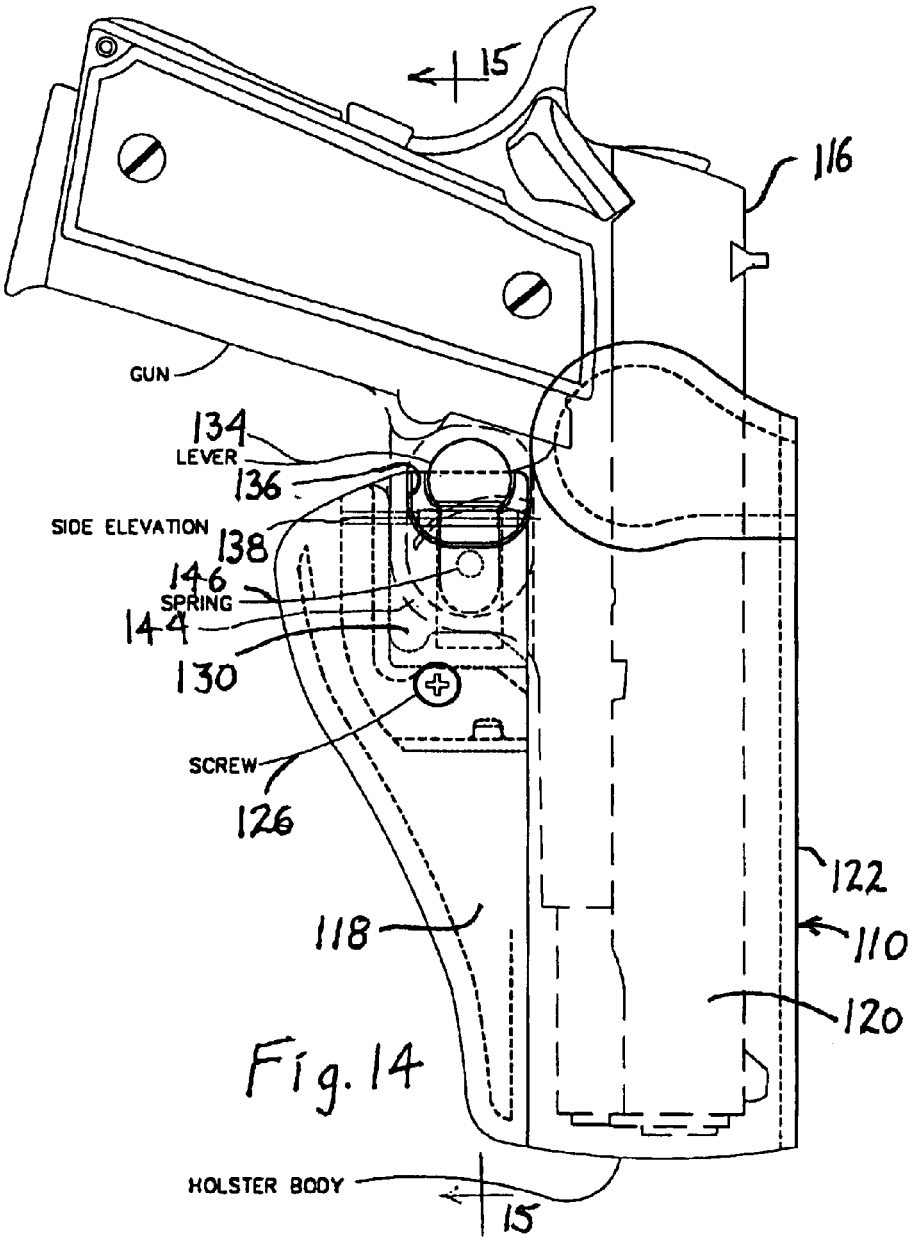

SECONDARY VERTICAL LATCHING LEVER AND SECONDARY HORIZONTAL LATCHING LEVER HOLSTERS

REFERENCE TO RELATED APPLICATION

This non-provisional patent application claims benefit of U.S. provisional patent application Serial No. 60/308,050 filed Jul. 25, 2001, and hereby claims the benefit of the embodiments therein and of the filing date thereof.

BACKGROUND OF THE INVENTION

From the earliest days in the development of the handgun holster, the need has been recognized for the holster to include a retention component to provide the user with some assurance that the handgun will not fall out, be dislodged or be subject to unauthorized removal. Classically, a holster flap or strap has acted as such a primary restraint. Both of these types have proved effective.

It has since been recognized that supplementary restraints are desirable. One of the earliest important supplementary restraint, in addition to a strap or flap, appeared in U.S. Pat. No. 3,630,420 to John E. Bianchi on Dec. 28, 1971, in which the handgun is restricted from withdrawal by a pocket which engages the handgun cylinder and a spring which together restrain the handgun from being drawn upward and allow drawing of the handgun only through a forward slot in the holster body.

For semi-automatic weapons, which have no cylinder, a variety of secondary restraints have been utilized. The most common approach has been to engage the trigger guard when the handgun is in place in the holster to be drawn only, by disengaging a trigger guard release. Examples of such secondary restraints are illustrated in the U.S. Patents:

U.S. Pat. No. 4,256,243 Bianchi et al. Mar. 17, 1981

U.S. Pat. No. 4,277,007 Bianchi et al. Jul. 7, 1981

U.S. Pat. No. 5,129,562 J. E. Bianchi Jul. 14, 1992

U.S. Pat. No. 5,199,620 Beletsky April 1993

U.S. Pat. No. 5,246,153 Beletsky September 1993

U.S. Pat. No. 6,085,951 R. Beletsky et al. Jul. 11, 2000

These patents illustrate the intense efforts which have gone into development of secondary trigger guard-type restraints, yet continuing improvements are underway.

BRIEF DESCRIPTION OF THE INVENTION

Faced with this state of the art, we have produced some simple, yet effective, secondary retention device holster designs providing automatic engagement upon holstering the handgun, one employing a vertical thumb release and others using a horizontal finger release for withdrawal of the handgun.

In the first embodiment, a spring loaded pivoted lever within an inboard housing is employed as the secondary restraint. The lever is pivoted about a generally horizontal shaft or pin at approximately the lever's midpoint constituting a first class type lever. A concealed spring, preferably a coil spring, is located within the inboard portion of the holster body and biases the lower trigger guard engaging portion of the lever into a restraining position within the trigger guard of the handgun when it is in holstered position.

The secondary retention device of this invention is preferably employed in a thumb break-type holster and is located below the thumb break. This allows a continuing motion of the thumb downward to first disengage the primary retention strap at the thumb break and then to continue downward to engage the operating end of the secondary retention device, press it inward, releasing the trigger guard and allowing smooth drawing of the handgun by an upward arm and hand movement.

In an alternate embodiment, a two-lever system is used. The two levers reside in the inboard housing. These horizontal levers are fulcrumed with vertical pins. The user applies finger pressure to the end of a first lever, which pivots about a first fulcrum and contacting a second lever, which rotates about a second fulcrum. The second lever houses a compression coil spring, which pushes the second lever outward to catch the gun's trigger guard. As the first lever rotates the second lever, the projection that engages the trigger guard rotates inward. With this projection rotated inward, the user may withdraw the gun upwardly. When the user releases the first lever, the spring causes the levers to return to their original rested position. When the user returns the gun to the holster, the levers automatically move to catch the trigger guard when it is lowered to its home position.

The boss or projection includes a tapered outer edge to allow the trigger guard to displace the lever out of the way upon holstering a handgun and a planar inner edge for blocking withdrawal of the handgun unless the lever is depressed. The first lever is easily actuated by movement of the middle finger of the hand during the grasping of the handgun grip. If the holster is of the thumb break type, the actuation of the trigger guard retention release is nearly simultaneous with the thumb release of the thumbneck strap.

An additional embodiment utilizes a finger-operated latching lever positioned on the outside of the holster. The accessible surface of the lever is, or may be, made smoothly flush with the outside surface of the holster body, which tends to minimize the chance of inadvertent or unauthorized operation of the latching lever.

All of these embodiments can provide simple, effective, secondary retention features to most belt worn holsters and possibly other types of holsters, as well.

BRIEF DESCRIPTION OF THE DRAWINGS

This invention may be more clearly understood with the following detailed description and by reference to the drawings in which:

FIG. 14 is an outer side elevational view of a further embodiment having an outside latching lever holster shown partly in phantom;

FIG. 16 is a top view partly in section of the holster of FIGS. 14 and 15.

DESCRIPTION OF THE PREFERRED EMBODIMENT

Figure 1:
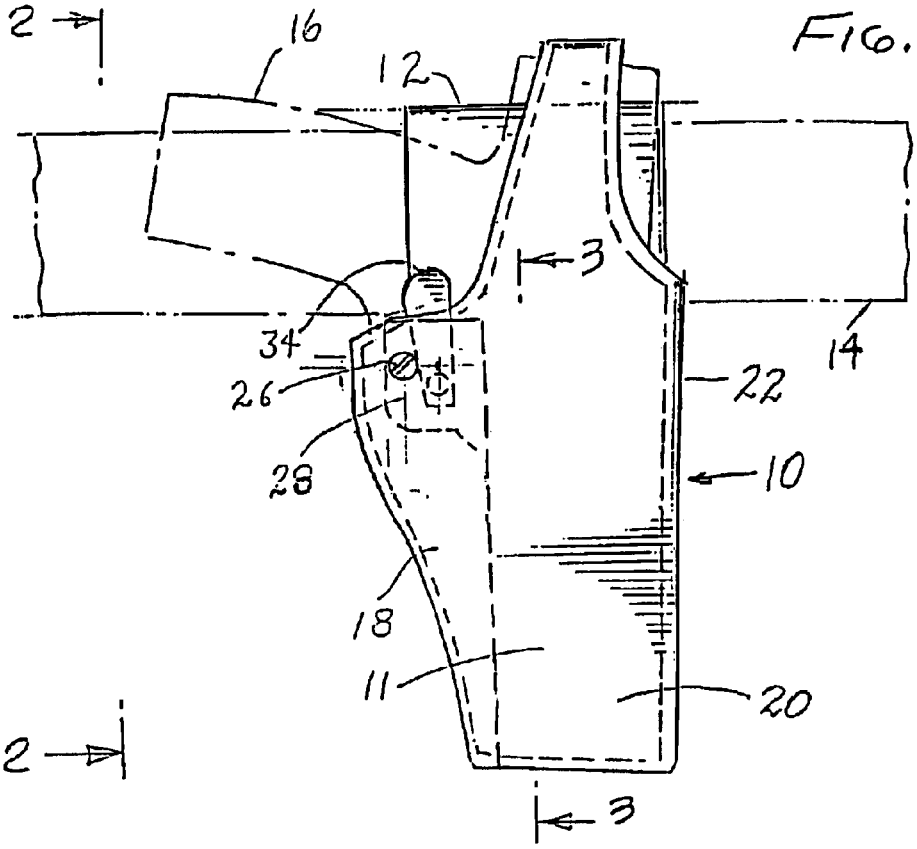
FIG. 1 is an elevational view of a thumb break-type strap holster incorporating the invention and showing its outside face and a secondary handgun restraint, vertical lever type.

Referring now to FIG. 1, a holster 10, with a conventional thumb break strap and a secondary retention device is shown, including a body 11 and a belt loop member 12, which is preferably of a molded plastic, such as nylon. The holster's belt loop 12 is on a belt 14. A handgun 16 shown in phantom is inserted into the holster 10. The body 11 may be of leather, leather-like material or of woven material, such as ballistic nylon. Secured to and forming part of holster 10 is a welt 18 shown in dashed lines.

Holster 10 in the preferred form is a folded leather or synthetic pouch having an outside face 20, a front face 22, which is the folded over part adjacent to the gun sight and the top of the handgun barrel or slide, an inside face 24 (FIG. 2) and a rear surface which, in this case, includes the edge of welt 18 to which the edges of outside face 20 and inside face 24 are secured, preferably by stitching to close the holster 10. Secured to welt 18, by means of one or more screws or rivets 26, is an inboard housing 28 and an outboard guide 102 which may be of metal, such as aluminum, although it could be of another durable material, such as steel or acetyl delrin. Above the inboard housing 28 a portion of the secondary restraint lever 34 may be seen.

Figure 2:
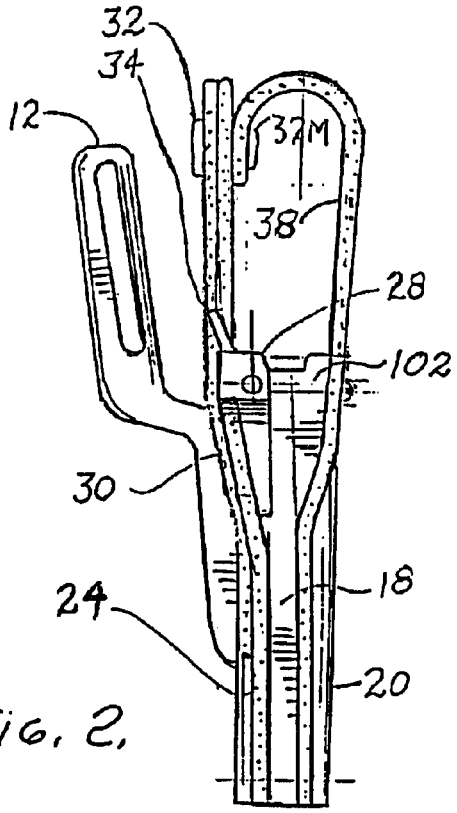
FIG. 2 is a rear view of the holster of FIG. 1.
Figure 6:
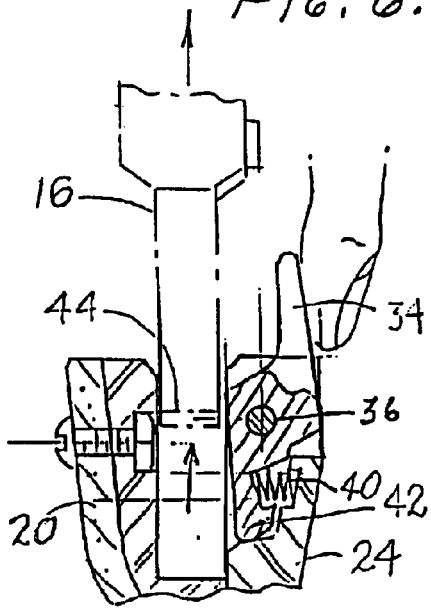
FIG. 6 is a fragmentary vertical sectional view similar to FIG. 3 as a handgun is being withdrawn from the holster of FIG. 1.

FIG. 2 is a view from the rear of holster 10. As will be seen from this view, an inboard housing 28 is positioned adjacent inner surface of inside face 24 of holster 10 and includes a thumb-operated lever 34 which is pivotally secured to inboard housing 28 by means of a pin 36 (FIGS. 3 and 6).

Stitched to inside face 24 is an additional stiffening layer 30 which provides an additional support for attaching belt loop 12 as well as a second leather or synthetic layer for supporting a thumb break snap fastener 32. Outside face 20 includes a strap 38 carrying the mating part 32M of snap fastener 32. Thus, inside face 24 as combined with stiffening layer 30 combines with strap 38 and snap fastener 32 to form a thumb break. An extension of strap 38 wraps over the top of handgun 16 to prevent its removal from holster 10 until the strap is released. This is the conventional thumb break holster operation.

Figure 3:
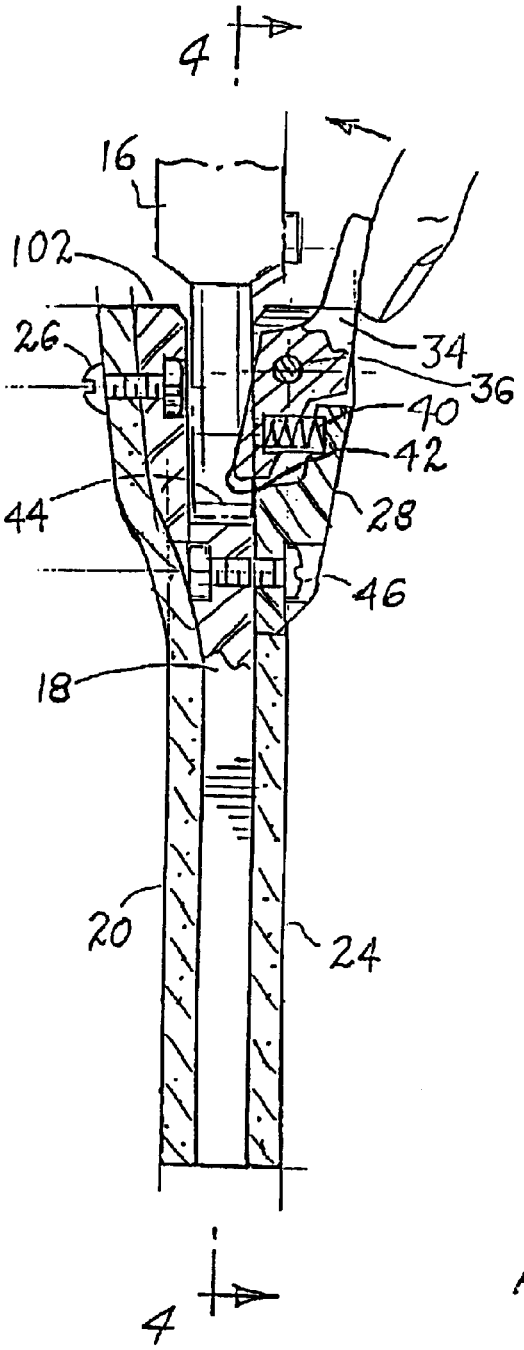
FIG. 3 is a fragmentary vertical sectional view taken along line 3—3 of FIG. 1.

FIG. 3 is a sectional view taken along line 3—3 of FIG. 1. In this view, it will be seen that the inboard housing 28 includes a thumb-operated lever 34 which is pivoted on a pin 36. Lever 34 is urged by means of a resilient member in the form of a compression spring 40 in a direction to force its contact boss 42 into the space within the trigger guard 44 of handgun 16. When handgun 16 is seated in holster 10 with thumb break fastener 32 secured, it is held in place both by the thumb break and by the contact boss 42 of lever 34. The lever 34 is accessible for operation only from the region between the holster body and the belt loop 12. The users thumb moves to open the thumb break, and in a continuing downward movement operates the lever 34 to release the handgun.

To withdraw handgun 16 requires that thumb break fastener 32 be opened With the operator's thumb, which is then moved to lever 34, moving lever 34 in the direction of the arrow of FIG. 3 to release contact boss 42 from trigger guard 44 before handgun 16 can be pulled out of the holster.

Also shown in FIG. 3 is a second screw 46 which fastens welt 18, inboard housing 28, outboard guide 102, and inside face layer 24 together.

Figure 4:
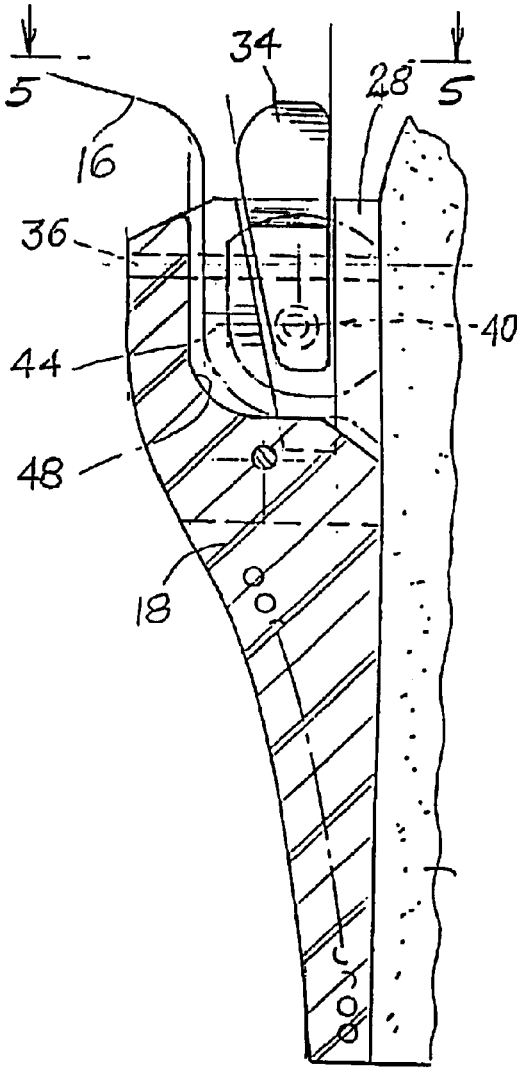
FIG. 4 is a partial vertical sectional view of the holster of FIGS. 1–3 taken along line 4—4 of FIG. 3.

FIG. 4 is a partial sectional view taken along line 4—4 of FIG. 3. This view shows that welt 18 has a cut out 48 at its upper end to receive the trigger guard 44 of handgun 16. The inboard housing 28 is shown along with lever 34. Pivot pin 36 and coil spring 40 are shown in phantom.

Figure 5:
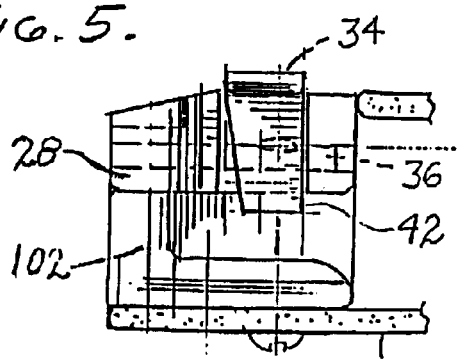
FIG. 5 is a top view of the holster of FIGS. 1–4 taken along line 5—5 of FIG. 4.

FIG. 5 is a top view taken along line 5—5 of FIG. 4 and shows inboard housing 28 and outboard guide 102 as seen from the top, including lever 34 shown in its normal position where contact boss 42 is urged by spring 40 into the space for the trigger guard. Pivot pin 36 is shown in dashed line.

FIG. 6 is a fragmentary sectional view similar to FIG. 3 but showing the lever 34 being operated by the thumb of an operator, rotating the contact boss 42 of lever 34 away from the trigger guard area against the force of spring 40. This releases the trigger guard 44 and permits handgun 16 to be removed from holster 10.

Figure 7:
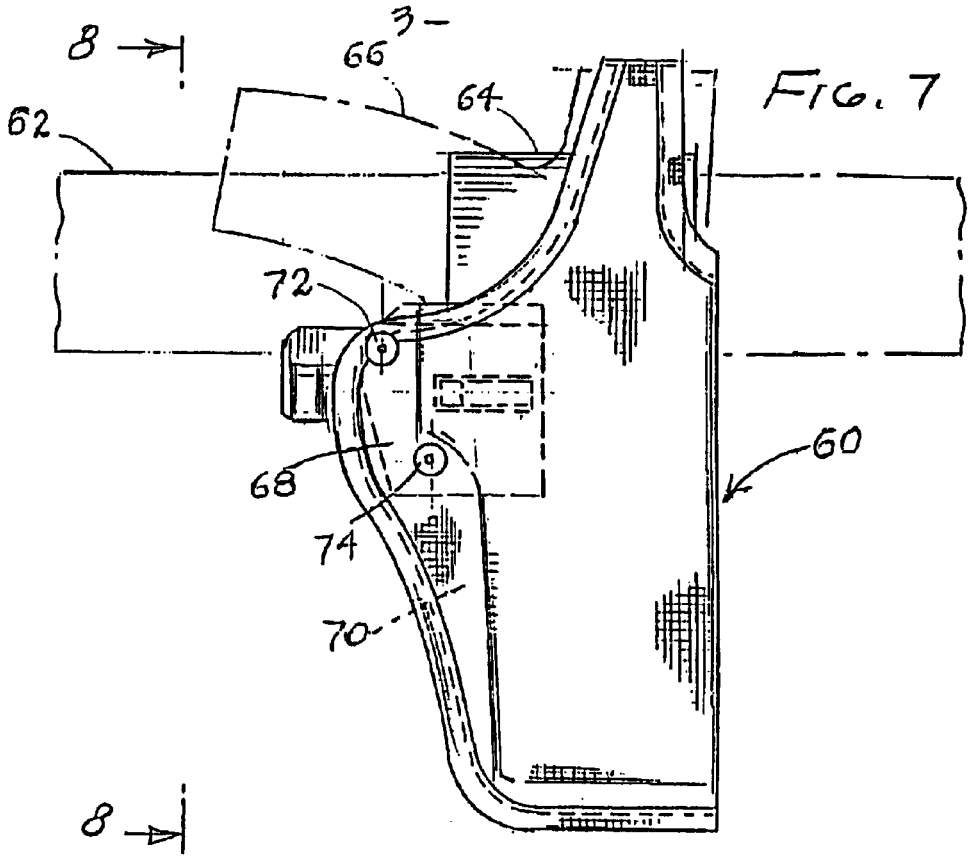
FIG. 7 is an outer side elevational view of an alternative embodiment holster showing its outside face and a horizontal lever type secondary restraint.
Figure 8:
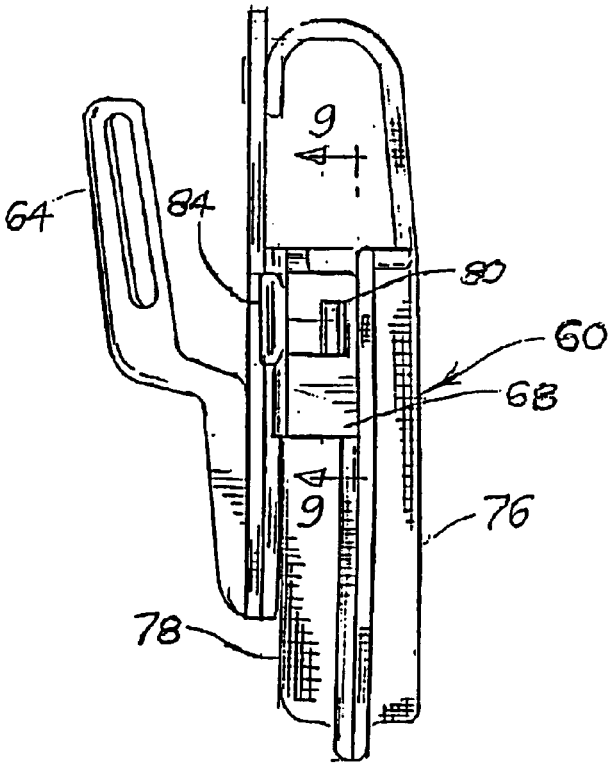
FIG. 8 is a rear elevational view of the holster of FIG. 7.
Figure 9:
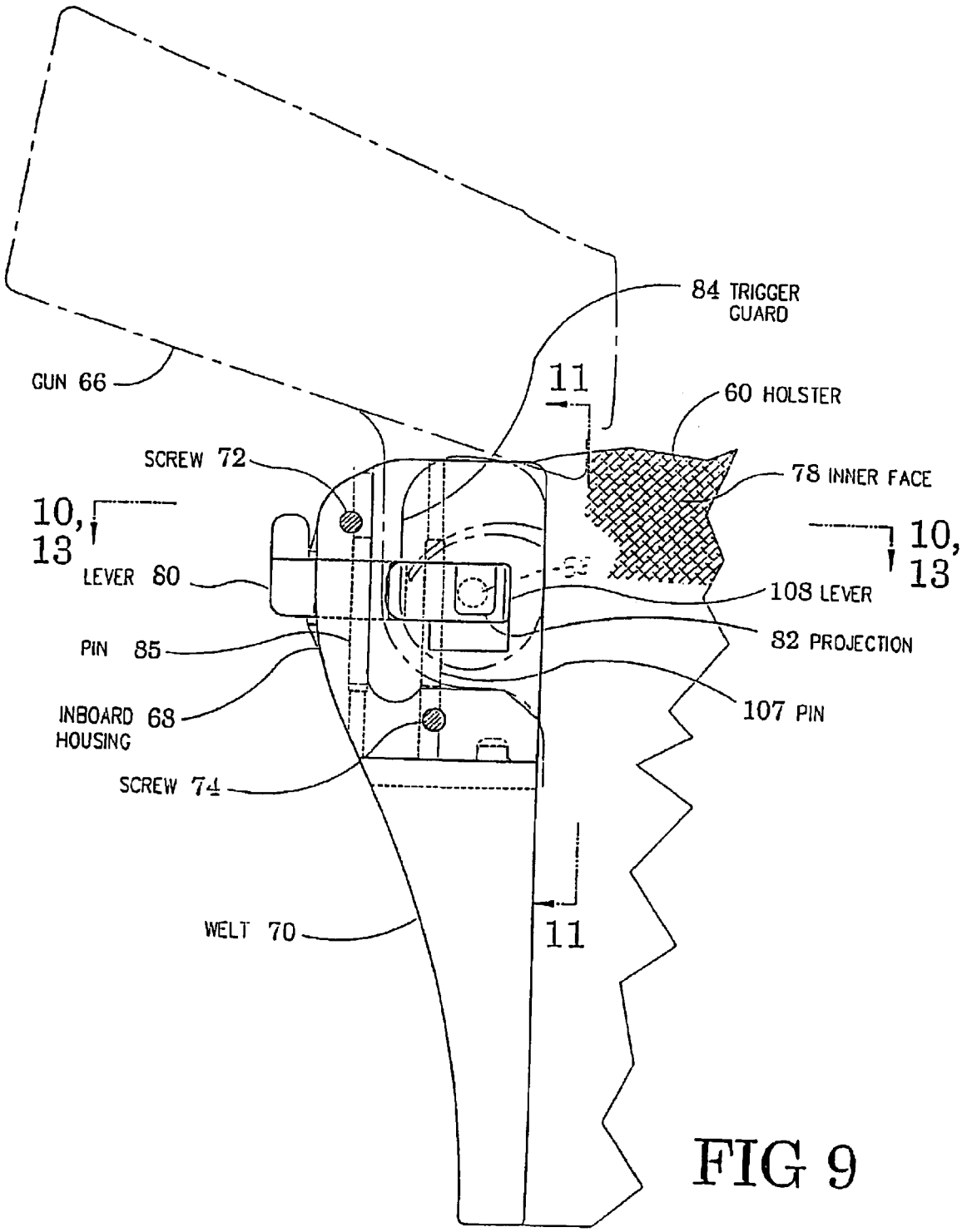
FIG. 9 is a fragmentary vertical sectional view taken along line 9—9 of FIG. 8.
Figure 10:
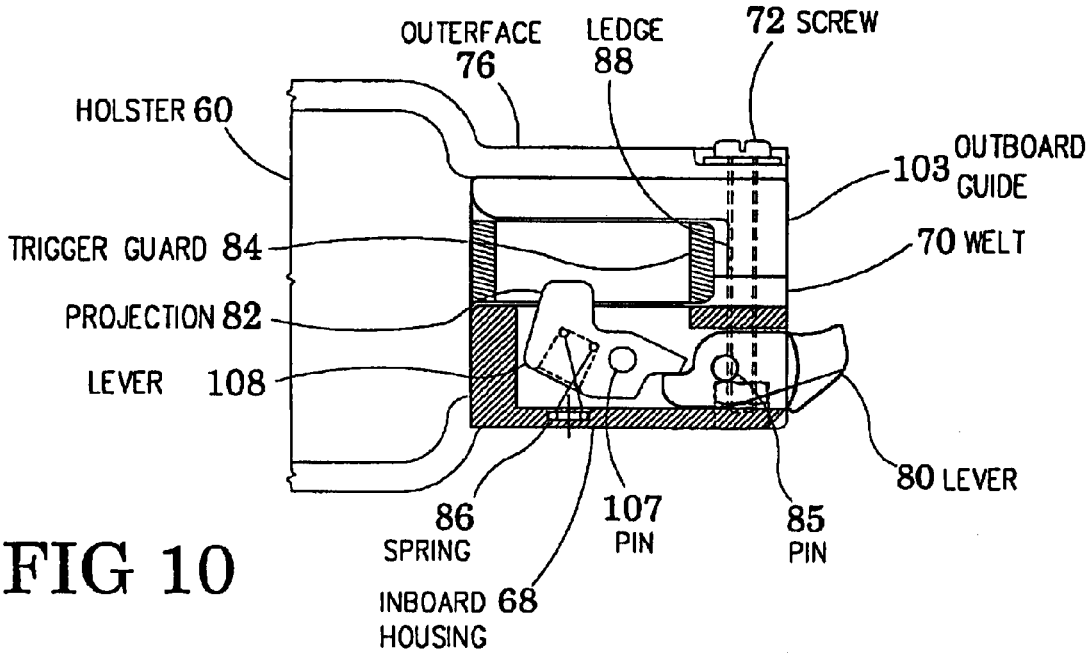
FIG. 10 is a fragmentary horizontal sectional view taken along line 10—10 of FIG. 9.

An alternative embodiment of the invention, with a horizontal lever mechanism, is shown in FIGS. 7–13. Referring now to FIG. 7, a holster 60, which may be similar to holster 10 or it may be made of a trilaminate with an outer cover of a strong fabric, such as ballistic nylon, is suspended from a belt 62 by means of a molded belt loop member 64, which may be similar to or the same as belt loop member 12 of FIG. 1. A handgun 66, shown in phantom, is carried in the holster 60 and is held in the holster by means of a thumb break which, although of fabric instead of leather, is essentially the same as that described above. A inboard housing 68 is secured to a welt 70 by means of a pair of screws 72, 74, welt 70 being fastened between inboard housing and an outboard guide 103 (FIG. 10).

FIG. 8 is a view of holster 60, as seen from the rear. This view shows a fabric outside face 76, a similar fabric inside face 78 and the molded belt loop member 64 secured to inside face 78. Inboard housing 68 is shown, including a lever 80.

FIG. 9 is a sectional view taken along line 9—9 of FIG. 8 and shows lever 80, which is secured to inboard housing assembly 68 by means of a pivot pin 85. A projection 82 on a second lever 108 extends within the trigger guard 84 of handgun 66.

FIG. 10 is a sectional view taken along line 10—10 of FIG. 9 and shows the inboard housing 68 and lever 80 as seen from above. This view shows lever 80 in its normal position resting against lever 108 with a compression spring 86 urging projection 82 into the space within trigger guard 84. It will be observed that the outboard guide 103 has a ledge 88 which serves as a stop for trigger guard 84 as handgun 66 is placed in the holster 60.

Figure 11:
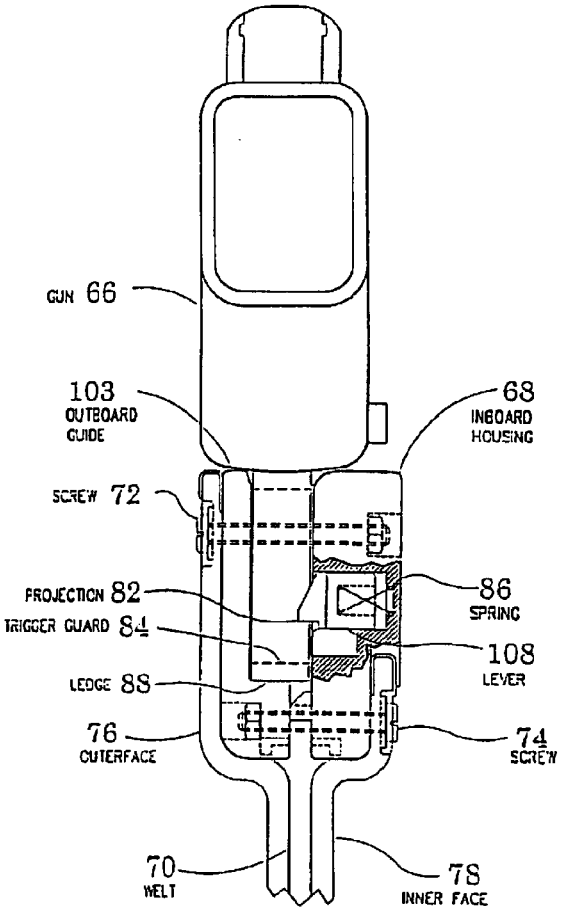
FIG. 11 is a vertical sectional view taken along line 11—11 of FIG. 9 with a handgun in a holstered position.

FIG. 11 is a sectional view taken along line 11—11 of FIG. 9 and shows inboard housing 68 secured to inner face 78 with projection 82 of lever 108 urged into the space behind trigger guard 84 by spring 86, to hold the gun in position.

Figure 12:
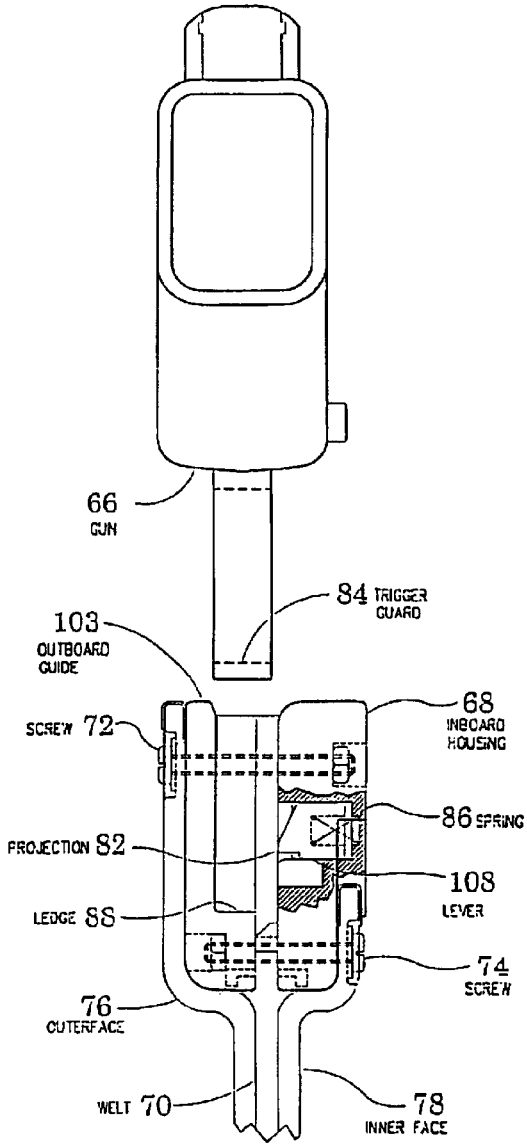
FIG. 12 is a vertical sectional view similar to FIG. 11 with the secondary restraint released and the handgun being withdrawn from the holster of FIG. 7.

FIG. 12 is the same view as FIG. 11 but showing projection 82 of lever 108 moved clear of the trigger guard 84 and permitting handgun 66 to be removed from holster 60. In this view, the spring 86 is compressed.

Figure 13:
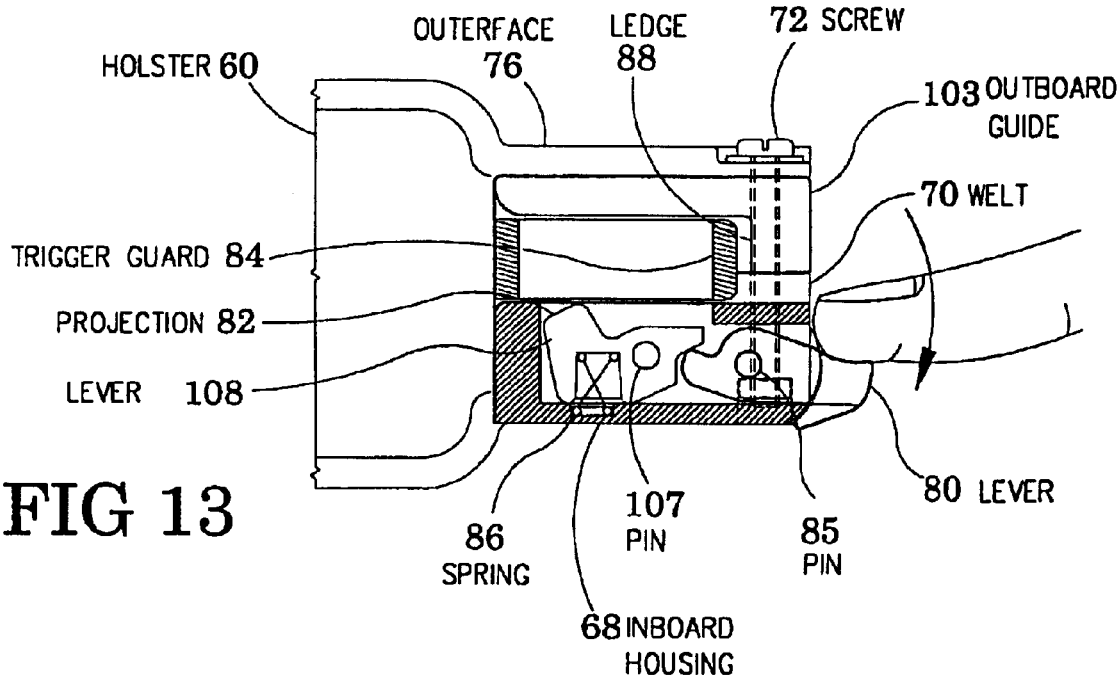
FIG. 13 is a fragmentary horizontal sectional view taken along line 13—13 of the holster of FIG. 9 during release of the secondary restraint.

FIG. 13 is a view similar to FIG. 10 but showing that the operator has moved lever 80 in the direction shown by the arrow of FIG. 10 causing lever 80 to pivot around pin 85 moving lever 108 to compress spring 86, and moving the projection 82 out of the space through which the trigger guard must move to release handgun 66 from holster 60.

From the foregoing, it will be seen that the structures described above provide simple and straightforward secondary latches for securing a handgun in a holster in addition to the well-known thumb break. The structure is durable and uncomplicated and, with either embodiment, easy and natural for a user to operate. Note that the outboard guides 102 and 103 serve both to locate the handgun in a position to lock the handgun in place but also prevent any twisting motion of the handgun that could defeat the retention.

Figure 15:
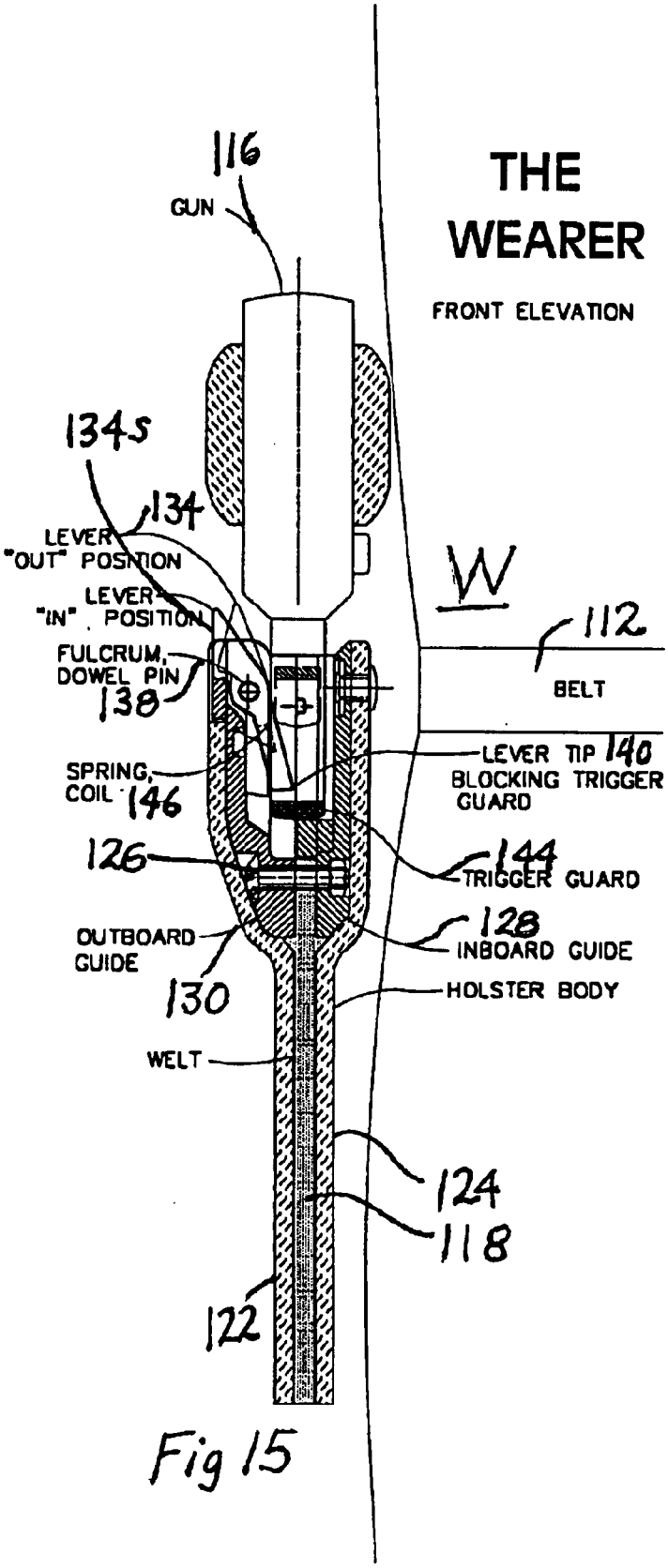
FIG. 15 is a sectional view of the holster of FIG. 14 taken along line 15—15 of FIG. 14.

A third embodiment of the present invention shown in FIGS. 14–16 utilizes a finger-operated latching lever positioned on the outside of the holster. FIG. 14 shows a holster 110 which, in its preferred form, is a folded leather or synthetic pouch having an outside face 120, a front face 122, an inside face 124 (FIG. 15), and a rear surface which includes a welt 118 to which the edges of outside face 120 and inside face 124 are secured, such as by stitching to close holster 110.

Secured to welt 118 by mans of one or more screws or rivets 126 is an inboard guide member 128 and an outboard guide 130 which may be of metal, such as aluminum, although it could be of another durable metal, such as steel or acetyl delrin. A handgun 116 is shown positioned in holster 110, including a trigger guard 144. Also visible in this view is a lever 134 positioned in a cut out 136 of outboard guide 130. Lever 134 is supported on a dowel pin 138 carried in outboard guide 130 and best seen in FIGS. 15 and 16.

FIG. 15 is a sectional view taken along line 15—15 of FIG. 14. As seen in this view, the inside face 124 is carried next to the wearer W. A belt-loop member is not shown but could well be identical to belt loop member 12 of FIG. 2 and secured to the belt 112 of wearer W. In this view, the lever 134 is shown pivotable on dowel pin 138 between a first position where the lever tip 140 blocks trigger guard 144, and a second position where lever tip 140 is moved out of the trigger guard space enabling the handgun 116 to be withdrawn from holster 110. Set in small wells or depressions in outboard guide 130 and lever 134 is a compression spring 146 which urges lever tip 140 into the space blocking trigger guard. To release handgun 116, the wearer W applies finger pressure to the surface 134S of lever 134, rotating the lever against the force of coil spring 146 to move lever tip 140 clear of trigger guard 144.

FIG. 16 is a top view of holster 110 with handgun 116 removed. Visible in this view are outside face 120, inside face 124, outboard guide 130, and inboard guide 128. The lever 134 is shown with fulcrum, dowel pin 138 shown in dotted lines to indicate that it is concealed within outboard guide 130.

The embodiment of FIGS. 14, 15 and 16 has been shown and described as applied to a holster which does not employ a strap and thumb break arrangement like that described in connection with FIGS. 1 and 2 or FIGS. 7 and 8; however, it will be appreciated by those skilled in the art that such additional restraint means can readily be adapted to the holster of FIGS. 14, 15, and 16.

The above described embodiments of the present invention are merely descriptive of its principles and are not to be considered limiting. The scope of the present invention instead shall be determined from the scope of the following claims including their equivalents.

We claim:

1. A holster for a handgun having a trigger guard comprising:

a pouch having an inside face and an outside face;

an outside guide and an inboard housing secured within said pouch and said inboard housing including a pivotable lever, including a finger-engaging end extending for movement by a finger of the wearer and a blocking end for engagement with the trigger guard of a handgun when positioned in said holster, and said outside guide providing a fixed surface serving as a stop for the trigger guard of a handgun in said holster;

resilient means for urging the blocking end of said lever into a position within the trigger guard such that the trigger guard is captured by said blocking end;

wherein removal of said handgun requires moving said finger-engaging end in opposition to the force of said resilient means into a position where said blocking end cannot engage said trigger guard.

2. A holster for a handgun having a trigger guard comprising:

a pouch having an inside face and an outside face;

a housing secured to said inside and outside faces of said pouch;

lever means pivotally secured within said pouch and including a finger-engaging end extending for movement by a finger of the wearer and a blocking end for engagement with the trigger guard of a handgun when positioned in said holster, said pivotable lever means comprising a first lever having a finger-engaging end and a contact end, and a second lever having a contact member engaging said contact end and including said blocking end;

resilient means for urging the blocking end of said second lever into a position within the trigger guard such that the trigger guard is captured by said blocking end;

wherein removal of said handgun requires moving said finger-engaging end in opposition to the force of said resilient means into a position where said blocking end cannot engage said trigger guard.

3. A holster for a handgun having a trigger guard comprising:

a pouch having an inside face and an outside face;

means for securing said inside and outside faces of said pouch together and for spacing said faces;

an inboard guide secured to said inside face providing a fixed surface serving as a stop for the trigger guard of a handgun in said holster;

an outside guide secured to said pouch and cooperating with said inboard guide to provide a cut-out recess for receiving said trigger guard, said outside guide including a pivotable lever having a finger-engagable end and a blocking end;

a resilient member urging the blocking end of said lever into a position within said trigger guard such that said trigger guard is captured by said blocking end; and wherein removal of said handgun requires moving of said finger-engaging end in opposition to the force of said resilient member into a position where said blocking end cannot engage said trigger guard.

4. A holster for a handgun having a trigger guard comprising:

a pouch having an inside face and an outside face;

a welt secured to said inside and outside faces of said pouch;

an outside guide and an inboard housing secured to said welt, said inboard housing including a pivotable lever secured to said inboard housing having a finger-engagable end and a blocking end;

a resilient member urging the blocking end of said lever into a position within said trigger guard such that said trigger guard is captured by said blocking end; and wherein removal of said handgun requires moving of said finger-engaging end in opposition to the force of said resilient member into a position where said blocking end cannot engage said trigger guard.

5. A holster for a handgun having a trigger guard comprising:

a pouch having an inside face and an outside face;

a welt secured to said inside and outside faces of said pouch;

an outboard guide secured to said welt and providing a cut-out recess for receiving said trigger guard;

an inboard housing secured to said welt;

said inboard housing including a pivotable lever having a thumb engaging end and a blocking end, and a resilient member urging the blocking end of said lever into said cut-out recess such that said trigger guard is captured by said blocking end; and wherein the removal of said handgun requires moving of said thumb-engaging end in opposition to the force of said resilient member into a position where said blocking end cannot engage said trigger guard.

6. A holster as claimed in claim 5 wherein said pivotable lever is secured to said outboard guide whereby said pivotal lever is engagable by a wearers finger on the outside face of said pouch.

7. A holster as claimed in claim 5 wherein said pivotable lever is secured to said inboard housing whereby said pivotal lever is engagable by a wearer's thumb on the inside face of said pouch.

8. A holster as claimed in claim 5 wherein said inside face thereof includes an outward extending strap having a snap fastener member at its end and said outside face includes a vertically extending strap having a mating snap fastener member on its end, said straps constituting a thumb break restraint which, when fastened, restrains removal of said handgun from said holster.

9. A holster for a handgun having a trigger guard comprising:

a pouch having an inside face and an outside face and an opening at one end for receiving said handgun, said outside face including an integral strap having a fastening member at its end, said inside face having a mating fastener means, said fastening members being capable of being fastened together to hold said handgun in said pouch;

a housing secured to said inside and outside faces of said pouch;

a pivotable lever secured to said housing having a finger-engaging end, a blocking end, and a fulcrum pin secured in said housing between said finger-engaging end and said blocking end of said lever;

resilient means urging the blocking end of said lever into a position within the trigger guard such that the trigger guard is captured by said blocking end;

wherein removal of said handgun requires opening said strap and operating the finger-engaging end of said lever in opposition to the force of said resilient member to move said blocking end away from said trigger guard.

10. A holster for a handgun having a trigger guard comprising:

a pouch having an inside face and an outside face;

a welt secured to said inside and outside faces of said pouch;

an outboard guide secured to said welt within said pouch providing a cut-out recess for receiving said trigger guard and a surface serving as a stop for said trigger guard;

an inboard housing secured to said welt including pivotable levers having a finger-engagable end on one lever and on the second lever a blocking end;

a coil spring urging said blocking end of second lever into a position to capture said trigger guard between said blocking end and said stop;

whereby removal of said handgun requires moving of said finger-engaging end in opposition to the force of said coil spring into a position where said blocking end cannot engage said trigger guard.

11. A holster for a handgun having a trigger guard comprising:

a pouch having an inside face and an outside face;

a welt secured to said inside and outside faces of said pouch;

an inboard guide secured to said welt providing a fixed surface serving as a stop for the trigger guard of a handgun in said holster;

an outboard guide secured to said welt and cooperating with said inboard guide to provide a cut-out recess for receiving said trigger guard;

said outboard guide including a pivotable lever having a finger-engagable end and a blocking end, and a resilient member urging the blocking end of said lever into said cut-out recess such that said trigger guard is captured by said blocking end; and wherein the removal of said handgun requires moving of said finger-engagable end in opposition to the force of said resilient member into a position where said blocking end cannot engage said trigger guard.

12. A holster as claimed in claim 11 wherein said pivotable lever is secured to said outboard guide whereby said pivotal lever is engagable by a wearer's finger on the outside face of said pouch.

13. A holster for a handgun having a trigger guard comprising:

a pouch having an inside face and an outside face;

an inboard guide secured to said inside face providing a fixed surface serving as a stop for the trigger guard of a handgun in said holster;

an outboard guide secured to said outside face and cooperating with said inboard guide to provide a cut-out recess for receiving said trigger guard;

said outboard guide including a pivotable lever having a finger-engagable end and a blocking end, and a resilient member urging the blocking end of said lever into said cut-out recess such that said trigger guard is captured by said blocking end; and wherein the removal of said handgun requires moving of said finger-engagable end in opposition to the force of said resilient member into a position where said blocking end cannot engage said trigger guard.

14. A holster for a handgun having a trigger guard comprising:

a pouch having an inside face and an outside face and means for spacing and connecting said inside face and said outside face together;

an inboard guide secured to said inside face providing a cut-out recess for receiving said trigger guard and a fixed surface serving as a stop for the trigger guard of a handgun in said holster; and an outboard guide secured to said outside face including a pivotable lever having a finger-engagable end, a blocking end and a spring urging the blocking end of said lever into said cut-out recess such that said trigger guard is captured by said blocking end;

wherein the removal of said handgun requires moving of said finger-engagable end in opposition to the force of said spring into a position where said blocking end cannot engage said trigger guard.

* * * * *